United States Patent [19]

Saruwatari

[11] 4,047,384

[45] Sept. 13, 1977

[54] PUMP JACK DEVICE

[75] Inventor: Minoru Saruwatari, Calgary, Canada

[73] Assignee: Canadian Foremost Ltd., Calgary, Canada

[21] Appl. No.: 699,134

[22] Filed: June 23, 1976

[30] Foreign Application Priority Data

Apr. 9, 1976 Canada ..... 249962

[51] Int. Cl.[2] ..... F15B 9/04

[52] U.S. Cl. ..... 60/372; 60/464; 60/476; 91/218

[58] Field of Search ..... 60/327, 328, 369, 371, 60/372, 378, 380, 381, 383, 476, 464; 91/218, 275, 281, 304, 318

[56] References Cited

U.S. PATENT DOCUMENTS

| | | | |
|---|---|---|---|
| 2,560,676 | 7/1951 | White | 60/372 |
| 2,564,285 | 8/1951 | Smith | 60/372 |
| 3,499,284 | 3/1970 | Johnson | 60/328 X |
| 3,939,656 | 2/1976 | Goldfein | 60/464 |

*Primary Examiner*—Edgar W. Geoghegan
*Attorney, Agent, or Firm*—Sughrue, Rothwell, Mion, Zinn and Macpeak

[57] ABSTRACT

A jack pump, such as the type capable of use in pumping crude oil from an oil well, the jack pump including a double acting piston and cylinder motor with the piston rod of the motor being adapted to be connected to the polished rod projecting upwardly from a well head. A variable displacement hydraulic pump, which is driven by a motor or engine, is included in a closed hydraulic loop wherein conduits are connected to a pair of output ports of the pump. A pump control means controls the direction and volume of flow in the loop so as to establish a total velocity profile during the complete pumping cycle and to determine the length and position of the stroke of the piston rod.

30 Claims, 2 Drawing Figures

PUMP JACK DEVICE

Figure 1A:
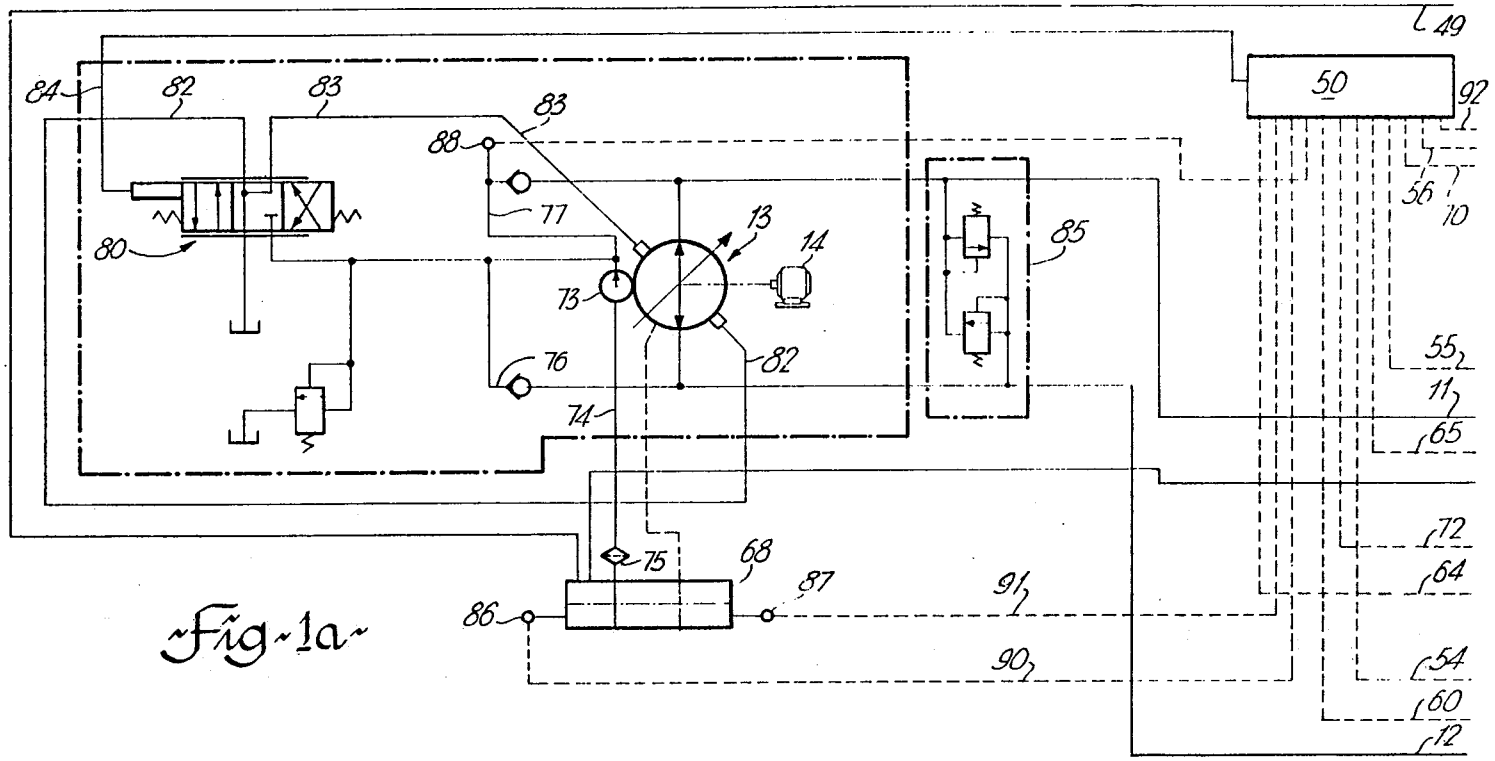

This invention relates to a jack pump of the type used to pump crude oil from an oil well.

The conventional oil well pump, which is of the walking beam type, has many disadvantages. Since the walking beam is driven usually from a rotating eccentric the stroking cycle is fixed. The characteristics, such as fluid level, specific gravity viscosity and pressure, vary from well to well, and although the strokes per minute, stroke length and position of the stroke can be adjusted, with considerable labour involved, in order to adapt the pump to a particular well, the nature of the velocity profile provided by the rotating eccentric does not result in efficient pumping. For example, if the strokes per minute are adjusted to raise the sucker rod quickly, the sucker rod may have a tendency to float on the downward stroke or the down hole pump may not have a sufficient opportunity to fill between the upward and downward strokes. If the speed is slowed to avoid such difficulties, then the portion of the cycle involved in the raising stroke takes a much longer period than is actually required. The approach which is taken is that of operating with the optimum speed while realizing that in a number of respects the pumping cycle has many inefficient portions. An additional problem is that the characteristics of some wells continuously change so that the operating efficiency may worsen over a period of time. Readjustment from time to time to again attempt to achieve optimum efficiency requires shutting down the pump and possibly many labour hours before restarting the pump.

The large massive parts customarily used in the walking beam type pump produce high dynamic forces which are difficult to control. The shipping, erecting and maintenance of such equipment is expensive. The start-up power demands are extremely high, and considerable energy is wasted in operation. High rod stress variations are also frequently experienced.

Although a number of different types of jack pumps, which include drive systems other than the walking beam arrangement, have been proposed, they generally have not proven satisfactory for one reason or another, and as a result the vast majority of oil well pumps in use to-day are of the walking beam type. The problem is becoming more acute, however, since it is becoming increasingly important to remove crude oil from less productive wells.

It is an object of the present invention to provide a jack pump which is efficient in operation and is economical to ship, erect and maintain.

According to the present invention there is provided a pump jack including a double acting piston and cylinder motor and means for connecting a piston rod of the motor to the polished rod which projects upwardly from a well head. A variable displacement type hydraulic pump is provided with a drive means which pump has a pair of output ports, and a pair of hydraulic conduits each places one of the ports in communication with an opposite end of the motor and forms a closed hydraulic loop with the motor and the pump. A pump control means is provided for controlling the direction and volume of flow in the loop so as to establish a total velocity profile during the complete pumping cycle and also to determine the length and position of the stroke of the piston rod.

The motor may be of the equal displacement through rod type.

According to one aspect of the invention there is provided a compressible fluid counterbalance means for accumulating energy during a down stroke of the piston and returning the energy to the piston rod during an up stroke of the piston rod.

The use of a closed loop system which includes a variable displacement pump permits each segment of the pumping cycle to be treated independently. Instantaneous control of the flow in the conduits supplying opposite ends of the motor can be achieved so that the velocity profile can be controlled to best suit the pumping stroke during the complete pumping cycle. This type of pump jack and particularly one which utilizes a compressible fluid counterbalance eliminates the need of massive parts which are difficult to transport and service.

Figure 1B:
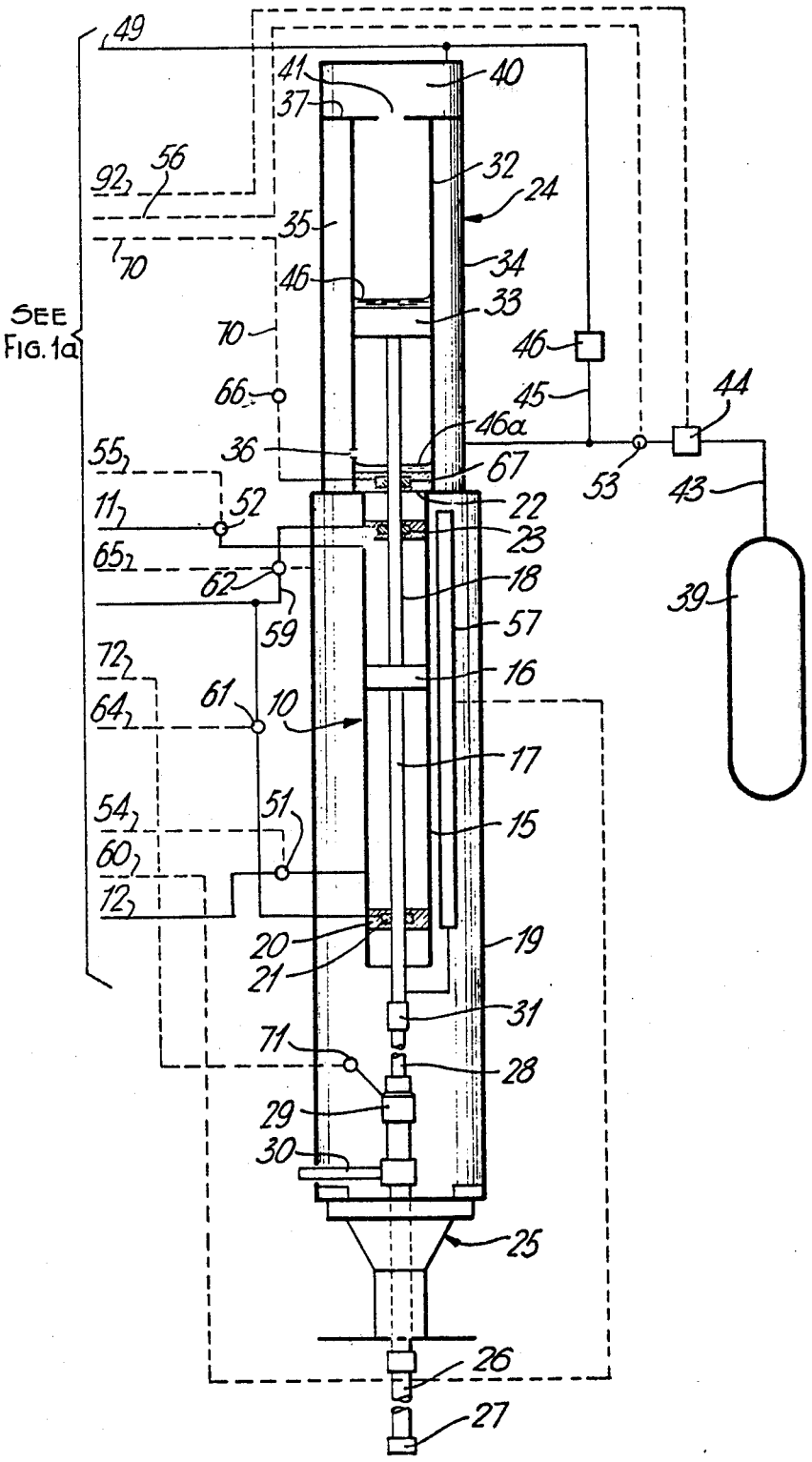

In the accompanying drawing in FIGS. 1*a* and 1*b*, there is shown a partially schematic diagram of the pump jack according to one embodiment of the present invention.

The reference number 10 denotes a piston and cylinder motor, which is connected by way of a pair of fluid conduits 11 and 12 to a variable displacement type hydraulic pump 13 driven by a prime mover 14.

The motor 10 includes a cylinder 15 and a piston 16 is reciprocably disposed within the cylinder 15. The motor 10 is preferably of the equal displacement through rod type, piston 16 having a first piston rod 17 and a second piston rod 18. The cylinder 15 has its opposite ends closed, with piston rod 17 passing through seal means 21 in lower end 20 and piston rod 18 passing through seal means 23 in upper end 22. In the embodiment shown, rods 17 and 18 are of the same diameter so as to provide an equal displacement hydraulic cylinder. Conduit 11 provides for the flow of fluid to and from one part of the pump 13 and the space between piston 10 and upper end 22, and conduit 12 provides for the flow of fluid to and from another port of the pump 13 and the space between the piston 16 and the lower end 20.

A compressible fluid counterbalance means 24 is mounted to the top of the motor 10 and the complete assembly of the counterbalance means 24 and motor 10 is carried by proper supporting means such as a casing 19 which may be secured to the top of a well head 25. Alternatively, a tripod mounting, which can be designed to permit simple alignment with screw adjustments, could be provided. The counterbalance means and motor assembly are mounted directly over the well head 25. A polished rod 28 is connected to a sucker rod chain 26 which extends down into the well and carries a pump plunger 27 at its lower end. The well head includes a stuffing box 29 through which the polished rod 28 passes and a flow line 30 is provided through which the output of the well is pumped by way of reciprocation of the sucker rod chain 26. The lower end of the piston rod 17 is provided with means 31 for connecting the piston rod 17 to the polished rod 2 so that the sucker rod 26 is driven by piston 16 reciprocating within cylinder 15.

The counterbalance means includes an inner sleeve and cylinder 32 in which a piston 33 is reciprocably mounted, the piston 33 being connected to the upper end of piston rod 18. An outer cylinder 34 is concentrically disposed about inner cylinder 32 so as to define as annular chamber 35 about the inner cuylinder 32. The space in inner cylinder 32 below the piston 33 is in communication with the chamber 35 via a port 36. The counterbalance means 24 is coaxially mounted on the motor 10 and the entire assembly is coaxial with the polished rod 28.

The upper ends of cylinders 32 and 34 are closed by an upper end 37. A closed expansion chamber 49 is carried above the upper end 37 and is in communication with the space above piston 33 by way of a port 41. A source 39 of pressurized inert gas, such as nitrogen, is connected by way of a conduit 43 to the chamber 35. A regulator 44 is located in the conduit 43 so as to control a high pressure charge, possibly in the order of 400 p.s.i. in the chamber 35 and below piston 33. Connected to conduit 43 on the output side of the regulator 44 is a conduit 45 which extends to the chamber 40. The conduit 45 includes a regulator 46 which regulates the nitrogen charged expansion chamber 40, the regulator allowing a much lower pressure, say 1 or 2 p.s.i., in the expansion chamber.

When piston 16 is positioned at the top of its stroke and pressurized fluid is conducted to the space above the piston 16, the piston is forced downwardly as fluid flows out of cylinder 15 through conduit 12. The sucker rod is thus lowered and simultaneously the gaseous charge below the piston 33 is compressed so as to accumulate energy from the system as the sucker rod is lowered. When the piston 16 reaches the bottom of its stroke, the fluid is exhausted from above piston 16 via conduit 11 and pressurized fluid is admitted to the space below the piston 16 to force the piston 16 upwardly with the assistance of the expansion of the fluid in annular chamber 35 and below piston 33, thereby raising the sucker rod 26. When the piston reaches the top of its stroke, a dwell may be provided before the above cycle is repeated.

It may be seen that with the particular design of the counterbalance shown, i.e., a relatively small inner cylinder with the annular chamber disposed thereabout, a more effective charge of pressurized gas can be utilized for the length of the stroke, which is fixed, of course, to the length of the stroke of piston 16. The charge may be regulated so that the power provided through conduit 12 to raise the sucker rod, in what might be termed the working stroke, is substantially equal to power provided through conduit 11 for the downward stroke during which the charge is compressed.

Rather than having the space above piston 33 open to atmosphere, it is preferable to provide the expansion chamber 40 in order to eliminate the possibility of contaminates entering the cylinder 32. A layer of oil 46 may be carried above the piston 33 for cooling, sealing and lubrication purposes. Another layer of oil **46*a* may be provided at the bottom of cylinder 32 to enhance the operation of seal 23 and lubricate rod 18.**

As an alternative to the concentrically disposed chamber 35, a completely separate pressure vessel could be utilized. As an example, the legs of the previously described tripod mounting could be made in a hollow configuration to provide accumulator chambers.

In addition to the expansion chamber 40 being hermetically sealed and operated within a closed and controlled atmosphere formed by the low pressure inert gas by way of its connection to conduit 45, other components, such as a main reservoir 68, may be similarly isolated from the face atmosphere at the well head. Conduit 49, for example extends from conduit 45 to the space above the oil in the reservoir.

The pump jack includes a control panel 50, which will be described as including electronic components, but a fluidic system could also be utilized. Transducers 51, 52, 53 are provided to sense the pressures at the lower end of the motor 10, at the upper end of the motor 10, and below the piston 33, respectively. The transducers 51, 52 and 53 are connected to the control panel 50 by way of leads 54, 55 and 56, the leads thus conducting to the control panel separate signals indicative of the pressures at opposite ends of the motor 10 and in the counterbalance means. A positional transducer 57 is located beside the cylinder 15 and transfers a signal by way of lead 60 to the control panel 50, the signal being indicative of the position of the piston 16. Since the position of piston 33 is indicative of the position of piston 16, instead of positional transducer 57 located beside the cylinder 15, a positional transducer might be located axially within the cylinder 32. Piston rod 18 could be hollow in such an arrangement so that the position transducer extends downwardly into the rod and does not engage either the piston 33 or rod 18 but provides a signal which reflects the relative position of the piston 33.

Return lines 58 and 59 may be provided to the reservoir 68 for returning fluid leaking around seal means 21 and 23. A transducer 61 may be associated with return line 58 and a transducer 62 may be associated with return line 59, the transducers 61 and 62 having leads 64 and 65 for transferring to the control panel signals indicative of whether the seals are functioning satisfactorily. Another transducer 66 may be associated with a seal 67 at the bottom of cylinder 33, for providing a signal via lead 70 indicative of the operability of the seal 67. A transducer might also be provided in conduit 43 to provide a signal when the pressure of source 39 falls below a predetermined value.

A further transducer 71, which is connected to the control panel 50 by a lead 72, may be provided in the well head, so that the presence of an unsatisfactory condition at the well head will be made known to the control panel.

The variable displacement pump may be of one of the types which are commercially available, such as those sold as a 20 series by Sundstrand or Models 28 through 149 sold by Eaton Corporation. These pumps are of the across-centre swashplate type. A charge plate 73 draws fluid from reservoir 68 via a conduit 74 through a filter 75 which provides make-up fluid to the main closed loop, which includes pump 13, conduits 11 and 12 and motor 10, via conduits 76 and 77. The output of charge pump 73 is further conducted to an electro-hydraulic servo means 80. The electro-hydraulic servo means 80 has a pair of outlet conduits 82 and 83 conducting fluid to pump 13 to thereby control the position of the swashplate, which in turn determines the volume flow and direction of flow in the closed loop. The activity of the means 80 is controlled by a lead 84 extending from the control panel 50 to the control valve 80.

A cross-over relief valve system 85 is provided between conduits 11 and 12. The output of charge pump 73 may be monitored by a transducer 88 connected to the control panel 59 by lead 85. Additional transducers 86 and 87 associated with the reservoir 68 are adapted to send signals to the control panel 50 via leads 90 and 91 indicative of the level of fluid and its temperature.

In addition to providing an output signal to control the electro-servo means or control valve 80, via lead 84, the control panel is also capable of conducting a signal via a lead 92 to control the actions of the pressure regulator valve 44. Moreover, the control panel may be adaped to produce other signals, such as one which is capable of starting or stopping prime mover 14 which may be, for example, an electric motor or an internal combustion engine under predetermined conditions.

In the embodiment shown in the accompanying drawings the signals from transducers 51, 52 and 53 may be summed by the control panel, and compared, for example with a predetermined value for a particular location of the piston 16, which location is indicated by transducer 57. A signal is produced as a result of the comparison, which signal is transferred to electro-servo control valve 81. As a result, the volume flow and/or direction in conduits 11 and 12 may be modified so that throughout the pumping cycles each segment of the velocity profile is controlled. The control panel may also be programmed to deviate completely from the normal pumping cycle. For example if extreme pressures, which could be caused with a jammed plunger are indicated by the transducers, the pumping cycle may be terminated. The panel may be further programmed to restart the cycle in a number of hours, but again terminate the pumping cycle if a jammed condition is still indicated. If the readings from the transducers indicate a gas lock, then proper signals could be provided to the pump to lower the stroke to a position in which the pump plunger could be tapped on the bottom a number of times to free the gas, after which the piston is raised to cycle in its normal stroke higher in cylinder 15.

The control panel could also be equipped to receive and/or transmit signals to a central control station. Thus, the operation of the pump could be controlled at least in part or it could be adjusted from a remote station. With this arrangement its operation could also be monitored and maintenance carried out so as to prevent costly break-downs.

As an alternative to the electronic control panel which continually receives all of the readings from the system, described above, the control panel might be simply provided with a program which might be set up for the particular well concerned and then simply repeats the preferable velocity profile throughout the selected stroke. As an alternative to the electro-hydraulic servo-means 80, a hydraulic servo could be controlled by a continuously rotating cam or similar mechanical means to provide a repeated pumping stroke havng a total profile selected for the well.

In the present invention an extra long stroke is possible, which has advantages over known pumps and would result in efficient pumping, this type of stroke being possible by simply utilizing a long stroke cylinder mounted direction directly on the well head. It may be advisable in such an arrangement to have the piston rod passing through the stuffing box and to not mount the counterbalance on top of the cylinder.

Although a single embodiment is shown in the accompanying drawing, it is apparent that various modifications could be made by those skilled in the art without departing from the spirit of the invention as defined in the appending claims.

I claim:

1. A pump jack comprising a double acting piston an cylinder motor; means for connecting a piston rod of said motor to a polished rod in a well head; a variable displacement type hydraulic pump having a pair of output ports; a pair of hydraulic conduits each placing one of said output ports in communication with an opposite end of said motor and forming a closed hydraulic loop with said motor and pump; drive means for said pump; and a pump control means including means indicative of desired instantaneous position and velocity of said piston for controlling the direction and volume of flow in said loop to thereby establish a total velocity profile during a complete pumping cycle and also to determine the length and position of the stroke of said piston rod.

2. A pump jack as defined in claim 1, wherein said motor is an equal displacement, through rod type.

3. A pump jack as defined in claim 2, and further comprising a compressible fluid counterbalance means for accumulation of energy during a down stroke of said piston rod and returning the energy to said piston rod during an up stroke of said piston rod.

4. A pump jack as defined in claim 3, wherein said counterbalance means includes a cylinder having a piston with means connecting the piston thereof to the piston of said motor for drive therewith, said cylinder and piston forming a chamber containing a gaseous charge disposed to be compressed by the piston of said counterbalance means during the downward stroke of said polished rod.

5. A pump jack as defined in claim 3, wherein the cylinder of said counterbalance means is coaxially mounted with said motor, said piston of said counterbalance means being directly connected to a second piston rod formed by the through rod of said motor.

6. A pump jack as defined in claim 4, wherein said motor is mounted above said well head and coaxial with said polished rod.

7. A pump jack as defined in claim 6, wherein the cylinder of said counterbalance means is mounted coaxially above said motor and is secured thereto.

8. A pump jack comprising a double acting piston and cylinder motor of an equal displacement, through rod type, said motor being arranged for mounting above a well head and coaxial with a polished rod in said well head; means for connecting a piston rod of said motor to the polished rod; a variable displacement type hydraulic pump having a pair of output ports; a pair of hydraulic conduits each placing one of said output ports in communication with an opposite end of said motor and forming a closed hydraulic loop with said motor and pump; drive means for said pump; a pump control means for controlling the direction and volume of flow in said loop to thereby establish a total velocity profile during a complete pumping cycle and also to determine the length and position of the stroke of said piston rod; a compressible fluid counterbalance means for accumulation of energy during a down stroke of said piston rod and returning the energy to said piston rod during an up stroke of said piston rod; said counterbalance means including a cylinder having a piston with means connecting the piston thereof to the piston of said motor for drive therewith, said cylinder and piston forming a chamber containing a gaseous charge disposed to be compressed by the piston of said counterbalance means during the downward stroke of said polished rod; the cylinder of said counterbalance means being mounted coaxially above said motor and being secured thereto; said cylinder of said counterbalance means including an inner sleeve and an outer cylinder forming an annular chamber therebetween, said piston of said counterbalance means being disposed within said sleeve and forming a chamber within said sleeve below said piston, port means placing said chamber below said piston and said annular chamber in communication to thereby form said chamber containing said gaseous charge.

9. A pump jack as defined in claim 4, wherein said gaseous charge is nitrogen.

10. A pump jack as defined in claim 8, and further comprising a closed expansion chamber, means placing said expansion chamber in communication with a chamber formed in said sleeve above the piston of said counterbalance means.

11. A pump jack as defined in claim 10 wherein said expansion chamber is fixedly mounted above the cylinder of said counterbalance means.

12. A pump jack device as defined in claim 11 wherein said expansion chamber is charged with low pressure nitrogen.

13. A pump jack as defined in claim 11 and further comprising a first conduit for connection to a source of high pressure nitrogen, said first conduit including a high pressure gas regulator and being connected to said annular chamber for supplying the gaseous charge thereto, a second conduit placing said first conduit in communication with said expansion chamber, said second conduit including a low pressure gas regulator.

14. A pump jack as defined in claim 1, wherein said control means includes means for continuously sensing changing operating characteristics of said pump jack and producing a signal for controlling the output of said pump.

15. A pump jack as defined in claim 1, wherein said control means includes at least one pressure sensing means for sensing pressure within said hydraulic loop and producing a signal for controlling the output of said pump.

16. A pump jack comprising a double acting piston and cylinder motor of an equal displacement, through rod type; means for connecting a piston rod of said motor to a polished rod in a well head; a variable displacement type hydraulic pump having a pair of output ports; a pair of hydraulic conduits each placing one of said output ports in communication with an opposite end of said motor and forming a closed hydraulic loop with said motor and pump; drive means for said pump; and a pump control means for controlling the direction and volume of flow in said loop to thereby establish a total velocity profile during a complete pumping cycle and also to determine the length and position of the stroke of said piston rod; a compressible fluid counterbalance means for accumulation of energy during a down stroke of said piston rod and returning the energy to said piston rod during an up stroke of said piston rod; said counterbalance means including a cylinder having a piston with means connecting the piston thereof to the piston of said motor for drive therewith, said cylinder and piston forming a chamber containing a gaseous charge disposed to be compressed by the piston of said counterbalance means during the downward stroke of said polished rod; said control means including first means for sensing the hydraulic pressure at one end of the piston and cylinder motor; second means for sensing the hydraulic pressure at the opposite end of the piston and cylinder motor; third means for sensing the position of the piston in said motor; each of the sensing means producing a signal indicative of the value sensed thereby; a control unit for reading signals from the sensing means, determining required flow in said loop, and producing signal for output of said pump.

17. A pump jack as defined in claim 16, and further including a means for sensing the pressure of gaseous charge within the chamber of the counterbalance means and transferring to said control unit a signal indicative of the pressure sensed thereby; and said control unit including means for summing the signals from the three pressure sensing means when producing the signal to control the output of the pump.

18. A pump jack comprising a double acting piston and cylinder motor of an equal displacement, through rod type; means for connecting a piston rod of said motor to a polished rod in a well head; a variable displacement type hydraulic pump having a pair of output ports; a pair of hydraulic conduits each placing one of said output ports in communication with an opposite end of said motor and forming a closed hydraulic loop with said motor and pump; drive means for said pump; and a pump control means for controlling the direction and volume of flow in said loop to thereby establish a total velocity profile during a complete pumping cycle and also to determine the length and position of the stroke of said piston rod; a compressible fluid counterbalance means for accumulation of energy during a down stroke of said piston rod and returning the energy to said piston rod during an up stroke of said piston rod; said counterbalance means including a cylinder having a piston with means connecting the piston thereof to the piston of said motor for drive therewith, said cylinder and piston forming a chamber containing a gaseous charge disposed to be compressed by the piston of said counterbalance means during the downward stroke of said polished rod; said control means including an electronic control unit; a first pressure transducer for sensing the hydraulic pressure in the cylinder at one end of the piston and cylinder motor and transferring signal indicative of the magnitude of the pressure to said control unit; a second pressure transducer for sensing the hydraulic pressure in the cylinder at the opposite end of the piston and cylinder motor and transferring a signal indicative of the magnitude of the pressure to said control unit; a third pressure transducer for sensing the pressure of the gaseous charge of the counterbalance means and transferring a signal indicative of the magnitude of the pressure to said control unit; and a positional transducer for sensing the position of the motor piston in its stroke and transferring a signal indicative of the piston position relative its total stroke capability to said control unit.

19. A pump jack as defined in claim 18, wherein an electronic control unit develops a command signal for said pump in response to a comparison being made of a programmed value with a value calculated from the signals provided by at least the signals from the four transducers.

20. A pump jack as defined in claim 19, wherein said electronic control unit includes means for summing the signals from the three pressure transducers, the sum then being compared with a predetermined value for each incremental position of the motor piston during its travel throughout a stroke.

21. A pump jack as defined in claim 19, wherein said pump is an across-centre type, and wherein said control means includes one electro-hydraulic servo-means controlled by said command signal.

22. A pump jack as defined in claim 17, and further including a source of pressurized gas and regulator means for regulating the flow of gas from the source, said control unit providing a signal to control the operation of said regulator means.

23. A pump jack comprising a double acting, through rod type piston and cylinder motor; means for connecting one piston rod of said motor to a polished rod projecting upward from a well head; a variable displacement type hydraulic pump; drive means for said pump; a pair of hydraulic conduits connected one each to opposite ends of said motor and to an output of said pump; a pump control means for controlling the directions and volume of flow in each of said conduits to thereby determine the speed, direction, acceleration, deceleration, dwell, length and position of the stroke of said piston rod, a counterbalance device including a cylinder having a piston with means connecting the piston thereof to the piston of said motor for drive therewith, said piston forming a chamber containing a gaseous charge for compression by the piston thereof during the downward stroke of said polished rod, said control means including a control unit, first and second pressure sensing means for providing to said control unit signal indicative of pressures in respective ends of said motor, a position sensing device for providing to said control unit a signal indicative of the position of the piston in said motor, said control unit providing a command signal for said pump in response to readings taken from said signals.

24. A pump jack as defined in claim 23, and further comprising a third pressure sensing means for providing to said control unit a signal indicative of the pressure in said chamber of said counterbalance device.

25. A pump jack as defined in claim 23, wherein said control unit is an electronic unit operating from a predetermined programme.

26. A pump jack as defined in claim 23 wherein said well head includes a first transducer for measuring leakage about said polished rod and a second transducer for measuring output flow from said well head, and further including means in said control unit for providing a signal to terminate operation of said motor in response to predeterminal signals from said transducers.

27. A pump jack as defined in claim 26, and further comprising transducer means for sensing leakage around the piston rod of said motor, and further including means in said control unit, for providing a signal to terminate operation of said motor in response to a predetermined signal from said transducers.

28. A pump jack as defined in claim 25, and further comprising transmitting means for transferring information from said control unit to a central control station, and receiving means for receiving additional command signals from said central control station.

29. A pump jack comprising a double acting piston and cylinder motor; means for connecting a piston rod of said motor to a polished rod in a well head; said motor being mounted above said well head and coaxial with said polished rod; a variable displacement type hydraulic pump having a pair of output ports; a pair of hydraulic conduits each placing one of said output ports in communication with an opposite end of said motor and forming a closed hydraulic loop with said motor and pump; drive means for said pump; a pump control means for controlling the direction and volume of flow in said loop to thereby establish a total velocity profile during a complete pumping cycle and also to determine the length and position of the stroke of said piston rod; and a compressible fluid counterbalance means for accumulation of energy during a down stroke of said piston rod and returning the energy to said piston rod during an up stroke of said piston rod.

30. A pump jack as defined in claim 29, wherein said counterbalance means includes a cylinder having a piston with means connecting the piston thereof to the piston of said motor for drive therewith, said cylinder and piston forming a chamber containing a gaseous charge disposed to be compressed by the piston of said counterbalance means during the downward stroke of said polished rod; the cylinder of said counterbalance means being mounted coaxially above said motor and being secured thereto; said piston of said counterbalance means being directly connected to a second piston rod formed by the through rod of said motor.

* * * * *